US006564712B2

(12) United States Patent
Sato et al.

(10) Patent No.: US 6,564,712 B2
(45) Date of Patent: May 20, 2003

(54) LITHOGRAPHIC PLATE MATERIAL

(75) Inventors: Hironori Sato, Saitama (JP); Junichi Nouda, Tokyo (JP); Toshimichi Katsuoka, Tokyo (JP)

(73) Assignee: Kimoto Co., Ltd. (JP)

( * ) Notice: Subject to any disclaimer, the term of this patent is extended or adjusted under 35 U.S.C. 154(b) by 0 days.

(21) Appl. No.: 09/880,860

(22) Filed: Jun. 15, 2001

(65) Prior Publication Data

US 2002/0012799 A1 Jan. 31, 2002

(30) Foreign Application Priority Data

Jun. 19, 2000 (JP) ..... 2000-182898

(51) Int. Cl.[7] ..... B41N 1/14
(52) U.S. Cl. ..... 101/462
(58) Field of Search ..... 101/453, 454, 101/457, 458, 459, 460, 462; 428/195, 409

(56) References Cited

U.S. PATENT DOCUMENTS 5,156,723 A * 10/1992 Pliefke et al. ..... 204/129.75
5,460,918 A * 10/1995 Ali et al. ..... 101/453
5,728,503 A * 3/1998 Dhillon et al. ..... 430/158
5,773,194 A * 6/1998 Hattori et al. ..... 430/284.1
6,044,762 A * 4/2000 DeBoer et al. ..... 101/466
6,283,029 B1 * 9/2001 Tashiro et al. ..... 101/455
6,324,978 B1 * 12/2001 Kaulen et al. ..... 101/459

FOREIGN PATENT DOCUMENTS

JP 11-24275 * 1/1999

* cited by examiner

*Primary Examiner*—Stephen R. Funk
(74) *Attorney, Agent, or Firm*—Lorusso, Loud & Kelly

(57) ABSTRACT

There is provided a lithographic plate material with which a lithographic plate is prepared by the hot-melt transfer recording method utilizing an ink ribbon. The lithographic plate material has an image-receptive layer for hot-melt transfer recording that has a water retention property or can be imparted with a water retention property on a support, and the image-receptive layer has a surface roughness (JIS-B06011994) of 0.15 $\mu$m or more in terms of arithmetic mean deviation Ra and 1.00–3.00 $\mu$m in terms of 10-point height of irregularities Rz. It shows good transfer of the ink layer of ink ribbon and excellent fixation of the ink layer, and it enables production of a printing plate having excellent printing durability.

5 Claims, No Drawings

LITHOGRAPHIC PLATE MATERIAL

CROSS-REFERENCE TO RELATED APPLICATION

This application claims, under 35 USC 119, priority of Japanese Application Number 2000-182898 filed Jun. 19, 2000.

BACKGROUND OF THE INVENTION

The present invention relates to a material for producing a lithographic plate (also referred to as a "printing plate" hereinafter) by the hot-melt transfer recording method utilizing a hot-melt transfer recording medium (ink ribbon).

Recently, there have been proposed plate making methods in which image signals from computers are directly output on a printing plate material by using a digital outputting machine equipped with a thermal head or infrared semiconductor laser, without outputting the image signals onto a photographic paper or lithographic film. As one of such direct plate making methods, a plate making method based on the hot-melt transfer recording method utilizing a hot-melt transfer recording medium (ink ribbon) is disclosed in Japanese Patent Laid-open Publication (Kokai) No. 10-16420.

In the hot-melt transfer using an ink ribbon, if the transfer and fixation of the ink layer are not sufficient, problems occur due to insufficient printing durability of the printing plate, such as white omissions in solid image portions and omission of small dots or fine lines, when a lithographic plate material is used for plate making and then printing with that plate. Therefore, it is desirable that lithographic plate materials have good transfer and fixation of the ink from the ink layer of ink ribbon. However, surfaces of lithographic plate materials are generally made to have a certain degree of unevenness in order to impart water retention, and such unevenness may be a cause for the degradation of ink transfer of the ink layer of an ink ribbon. Moreover, when there is used a material having a surface preliminarily subjected to a hydrophilization treatment to eliminate the necessity of desensitization after plate making (referred to as a material of "non-etch type" hereinafter), the fixation of ink from the ink ribbon is reduced, and there remains the aforementioned problem of poor printing performance.

On the other hand, ink ribbons with a very thin ink layer have come to be used as ink ribbons in the hot-melt transfer recording method in order to attain printing with high resolution. And it is believed that, also in the plate making method utilizing the hot-melt transfer recording, printed matter of high resolution can be obtained by using such an ink ribbon having a very thin ink layer.

However, if such an ink ribbon having an extremely thin ink layer is used for the transfer onto a lithographic plate material having an uneven surface, as described above, the problem of poorer transfer results, that is, protrusions penetrate the ink layer, thus causing white omissions in solid image portions of the printed matter. Further, the protrusions in the non-image portions scrape the ink layer surface to cause scumming of the printed matter, and hence good printed images cannot be obtained.

In particular, the above-mentioned problem observed in image portions is particularly serious in the non-etch type material which includes a thermosetting water-soluble resin as a binder of the image-receptive layer. It is considered that this is because the uneven surface of the thermosetting water-soluble resin is scarcely flattened by heat and pressure of a thermal head used for the transfer of ink layer, although an uneven surface of a thermoplastic resin material may be flattened to a certain extent by heat and pressure.

Therefore, an object of the present invention is to provide a lithographic plate material that shows good ink layer transfer and excellent ink layer fixation and hence enables production of a printing plate having excellent printing durability even if an ink ribbon having a very thin ink layer is used. Another object of the present invention is to provide a lithographic plate material that shows excellent water retention, does not require desensitization treatment after plate making, and shows excellent fixation of the ink of the ink layer.

SUMMARY OF THE INVENTION

In order to achieve the aforementioned objects, the inventors of the present invention studied the surface conditions of lithographic plate materials. As a result, they found that, while the water retention showed correlation with arithmetical mean deviation Ra, which is a generally used parameter for surface roughness, and good water retention could be obtained in a certain range of arithmetical mean deviation Ra, depending on the material constituting the image-receptive layer, the mean surface roughness Ra was not necessarily reflected in quality of the transfer of ink from the ink ribbon, but it showed correlation with 10-point height of irregularities Rz, and good transfer and fixation could be obtained and water retention could also be secured within a certain range of 10-point height of irregularities Rz.

Specifically, the lithographic plate material of the present invention is a lithographic plate material having an image-receptive layer for hot-melt transfer recording formed on a support, the image-receptive layer having water retention or capable of being imparted with water retention, wherein the image-receptive layer has surface roughness (JIS-B0601-1994) of 0.15 $\mu$m or more in terms of arithmetical mean deviation Ra and 1.00–3.00 $\mu$m in terms of 10-point height of irregularities Rz.

In the lithographic plate material of the present invention, the image-receptive layer may contain a hydrophilic polymer binder and a surface roughening agent having an average particle diameter of 1.5–2.5 $\mu$m. Further, in the lithographic plate material of the present invention, the hydrophilic polymer binder may be a crosslinked hydrophilic polymer compound.

In the lithographic plate material of the present invention, the surface roughness of the image-receptive layer, in particular, the 10-point height of irregularities Rz, is selected to be within a specific range. This makes it possible to secure water retention for the surface, and to provide excellent transfer and fixation of the hot-melt transfer recording medium (ink ribbon). Thus, there can be obtained a printing plate showing excellent printing durability. In particular, it shows excellent transfer of ink from the ink layer of ink ribbon even when the ink layer is of a small thickness, and therefore it can provide a lithographic plate that provides printed images of high resolution.

PREFERRED EMBODIMENT OF THE INVENTION

The lithographic plate material of the present invention has a structure comprising a support and an image-receptive layer formed on the support, which enables hot-melt transfer recording utilizing an ink ribbon.

The support may be a plastic film composed of a resin such as polyethylene, polypropylene, polyvinyl chloride, polystyrene, polyethylene terephthalate, waterproof paper having such a plastic film laminated thereon or waterproof paper coated with such a resin.

A polyethylene terephthalate film is particularly preferred in view of its mechanical strength, dimensional stability, resistance to chemicals and water resistance. The support may be a film made of a resin mixed with a light-shielding pigment such as carbon black and titanium oxide in order to impart light-shielding. While the thickness of the support it not particularly limited, it is generally 50 μm to 300 μm.

In order to improve adhesion to the image-receptive layer, the support may be subjected to a plasma treatment, corona discharge treatment or far ultraviolet ray exposure. As a technique to give easy adhesion between the support and the image-receptive layer, an undercoat layer may be provided.

The undercoat layer is preferably composed of a resin showing good adhesion to both the support and the image-receptive layer. Therefore, the resin of the undercoat layer may differ depending on the nature of the resins used for the support and the image-receptive layer. Examples thereof include polymers and copolymers of vinyl acetate, vinyl chloride, styrene, butadiene, acrylic esters, methacrylic esters, ethylene, acrylonitrile and so forth, water-insoluble polymers such as polyester resins, polyurethane resins, alkyd resins and epoxy resins, water-soluble polymers such as polyvinyl alcohol, carboxymethyl cellulose, hydroxyethyl cellulose, casein, gelatin and water-soluble polyurethane and so forth. These resins maybe used each alone or in combination of two or more.

The undercoat layer is formed by applying a coating solution containing such a resin to a support. The thickness is not particularly limited, but it is usually 0.5 μm to 10 μm after it is dried.

The undercoat layer may contain additives such as electrically conductive agents, colorants, surfactants and crosslinking agents, as required.

The image-receptive layer should have surface roughness of 0.15 μm or more, preferably 0.25 μm or more, in terms of the arithmetical mean deviation Ra, and 1.00–3.00 μm, preferably 1.50–2.50 μm, in terms of the 10-point height of irregularities Rz.

The arithmetical mean deviation Ra means a value obtained as a uniform height of peaks and valleys existing on a surface roughness curve of an evaluation length, which is obtained by dividing an integral of the absolute values of the peak and valley heights by the evaluation length. The 10-point height of irregularities Rz is obtained as follows. That is, a surface roughness curve of an evaluation length, which length is N times as long as a sampling length equal to a cutoff value, is divided into N number of equal sections. For each section, Rz' is obtained as a difference of an average height of peaks having heights of first place to fifth place and an average height of valleys having depths of first place to fifth place. The 10-point height of irregularities Rz is obtained as an arithmetic average of N of Rz'.

Such surface roughness of the image-receptive layer determines the transfer and fixation of ink from the ink layer of the ink ribbon and ability to retain fountain solution (water retention property). When the arithmetical mean deviation Ra is less than 0.15 μm, sufficient water retention property cannot be obtained in a printing plate produced from the material, and hence scumming results.

Further, if the 10-point height of irregularities Rz exceeds 3.00 μm, good transfer of ink from the ink layer cannot be obtained. As a result, white omissions in solid image portions and so forth may be caused, and scumming of non-image portions may be caused by rubbing by the ink ribbon. The surface roughness of the image-receptive layer is also defined by the 10-point height of irregularities Rz for the following reasons. That is, when the surface roughness is defined only by an arithmetical mean deviation Ra of a certain range, a surface having peaks (protrusions) having a height significantly higher than the defined Ra value may be included in the defined surface, if the integrated area is small. And, if an ink from the ink layer is transferred onto a surface having such peaks (protrusions), the peaks (protrusions) penetrate the ink layer, and thus the ink layer is not transferred to such portions. On the other hand, if the surface roughness is also defined by the 10-point height of irregularities Rz, the defined surface would not have peaks of a height extremely higher than the defined Rz value, and therefore good transfer of ink from the ink layer can be secured by selecting the value to be within a proper range.

However, if the 10-point height of irregularities Rz is less than 1.00 μm, the fixation of the ink layer is degraded and thus sufficient printing durability cannot be obtained. Therefore, it should be 1.00 μm or more.

The image-receptive layer having such surface conditions may contain a hydrophilic polymer binder, inorganic microparticles for imparting water retention and a surface roughening agent for imparting the aforementioned predetermined surface roughness.

Examples of the hydrophilic polymer binder include hydrophilic polymer binders such as polyvinyl alcohol, carboxymethyl cellulose, hydroxyethyl cellulose, polyvinylpyrrolidone and methyl vinyl ether/maleic anhydride copolymer. In order to further improve water resistance and mechanical strength of the image-receptive layer, it is desirable to use known crosslinking agents such as melamine resins, epoxy resins, polyisocyanates, aldehyde compounds and silane compounds in combination. Particularly preferred is completely saponified polyvinyl alcohol crosslinked with tetraalkoxysilane hydrolysate as a crosslinking agent having a polymerization degree of less than 1000.

In order to improve water retention, waterproofness and mechanical strength, the image-receptive layer may further contain a resin emulsion such as an emulsion of a homopolymer or copolymer of vinyl chloride, vinyl acetate, acrylic esters, ethylene, styrene and so forth besides the aforementioned hydrophilic polymer binder, so long as the hydrophilicity is not reduced.

The inorganic microparticles are added in order to enhance the water retention property of the image-receptive layer by imparting fine unevenness.

Examples of such inorganic microparticles include those of zinc oxide, calcium carbonate, barium sulfate, silica, titanium oxide, clay, kaolin, aluminum hydroxide, alumina, and so forth. A combination of titanium oxide, colloidal silica and/or colloidal alumina is particularly suitable.

Further, the inorganic microparticles preferably have an average particle diameter of less than 1 μm, more preferably less than 0.2 μm. By using those having an average particle diameter of less than 1 μm, the surface area of the image-receptive layer can be sufficiently increased, and thus its water retention for fountain solution can be improved without degrading water resistance.

In order to obtain the aforementioned effect, the inorganic microparticles are preferably used in an amount of 150 parts by weight or more, more preferably 300 parts by weight or more, per 100 parts by weight of the binder resin. However, if the amount of the inorganic microparticles is unduly increased, the coated film becomes brittle, which leads to degradation of printing durability and so forth. Therefore, the amount is preferably 1000 parts by weight or less, more preferably 900 parts by weight or less.

Examples of the surface roughening agent for imparting the predetermined surface roughness to the image-receptive layer include inorganic microparticles such as those of calcium carbonate, barium sulfate, clay, silica and alumina, synthetic resin microparticles such as those of acrylate resins, epoxy resins, nylon resins, polyethylene resins, fluorocarbon resins, and benzoguanamine resins and so forth. Among these, those of silica, especially amorphous silica, are preferred, and those having an average particle diameter of 1.0–3.0 μm, preferably 1.5–2.5 μm, are used. Furthermore, those having a narrow particle size distribution are preferred.

If the average particle diameter exceeds 3.0 μm, or if the particle size distribution is broad and particles having a large particle diameter are present, even though the average particle diameter is small, the 10-point height of irregularities Rz exceeds 3.0 μm, and hence good transfer of ink from the ink layer cannot be obtained. Further, if the average particle diameter is less than 1.0 μm, most of the particles are buried in the resin constituting the image-receptive layer, and sufficient fixation of the ink from the ink layer cannot be obtained.

The amount of the surface roughening agent is 5–100 parts by weight, preferably 10–60 parts by weight, per 100 parts by weight of the binder resin constituting the image-receptive layer.

Besides the binder resin, inorganic microparticles and surface roughening agent mentioned above, the image-receptive layer may further contain additives such as electrically conductive agents, colorants and surfactants, as required, in an amount that does not degrade the aforementioned performance.

The lithographic plate material of the present invention can be prepared by applying a coating solution containing the materials constituting the image-receptive layer Onto a support directly or after a coating solution containing a resin constituting the undercoat layer is coated and dried to form an undercoat layer, and drying the coated image-receptive layer. When polyvinyl alcohol to be crosslinked with tetraalkoxysilane hydrolysate is used as the hydrophilic polymer binder of the image-receptive layer, a dispersion containing polyvinyl alcohol and inorganic microparticles in an alcohol and water as solvents is prepared beforehand, and then mixed with tetraalkoxysilane hydrolysate and a surface roughening agent to form a coating solution for forming the image-receptive layer. An image-receptive layer containing crosslinked polyvinyl alcohol as the hydrophilic polymer binder can be formed by applying the above coating solution to a support or an undercoat layer and drying it.

Although the thickness of the image-receptive layer is not particularly limited, it is preferably in the range of 1–10 μm, more preferably 3–7 μm. With a thickness of 1 μm or more, the image-receptive layer can have the water retention, good transfer and fixation of the ink from the ink layer, and with a thickness of less than 10 μm, flexibility of the image-receptive layer can be maintained.

The lithographic plate material of the present invention can also be provided with a layer imparting an additional function, such as an antistatic layer or anti-curl layer, on the surface of support opposite the surface provided with the image-receptive layer.

The lithographic plate material of the present invention is made into a printing plate by forming lipophilic transferred images on the hydrophilic image-receptive layer by the hot-melt transfer recording method utilizing a hot-melt transfer recording medium (ink ribbon). The image portions serve as ink-receiving portions that repel water and carry ink, and the non-image portions, where transferred images are not formed, serve as hydrophilic portions that carry fountain solution and repel ink.

The hot-melt transfer recording medium (ink ribbon) is formed by providing a lipophilic ink layer having a thickness of 0.5–4 μm on a polyester film support having a thickness of 3–6 μm. The ink layer comprises wax having a melting point of 60–120° C. such as paraffin wax, micro wax, polyethylene wax, carnauba wax, candelilla wax, montan wax and lanolin wax, a resin having a softening point of 60–200° C. such as polyester resins, acrylate resins, urethane resins, ethylene vinyl acetate resins, amide resins and polyterpene resins, a coloring pigment such as carbon black, and a dispersing agent.

The ink ribbon may have an overcoat layer on the ink layer in order to improve adhesion between the image-receptive layer of the present invention and the ink layer and to improve the transfer of the ink of the ink layer.

Because the lithographic plate material of the present invention has a specific surface roughness, in particular, 10-point height of irregularities Rz within a specific range, even if an ink ribbon having an ink layer with a thickness of about 1 μm is used, the ink layer is not broken by unevenness, and the hot-melt transfer ink layer can be surely and firmly fixed on the uneven surface. Thus, a printing plate showing excellent printing durability and high resolution can be obtained.

EXAMPLES

Hereinafter, examples of the lithographic plate material of the present invention will be given. In the following examples, "part" and "%" designate a weight basis unless otherwise indicated.

Example 1

On a support consisting of a white polyester film having a thickness of 125 μm, an undercoat layer was formed by applying a coating solution having the following composition so that the coated layer had a dry film thickness of 5 μm.

| Coating solution for undercoat layer | |
|---|---|
| - Polyester resin (Elitel UE3201, Unichika, Ltd.) | 10 parts |
| - Isocyanate prepolymer (solid content: 60%, Takenate D11ON, Takeda Chemical Industries, Ltd.) | 2 parts |
| - Toluene | 40 parts |
| - Methyl ethyl ketone | 40 parts |

Then, Dispersion A for the image-receptive layer having the following composition was prepared, and Coating solution B for the image-receptive layer was further prepared by using Dispersion A, coated on the aforementioned undercoat layer, and dried to form an image-receptive layer having a thickness of 7 μm. Thus, a lithographic plate material was obtained.

| Dispersion A for image-receptive layer | |
|---|---|
| - Inorganic microparticles (titanium oxide, average particle size: 0.12 μm, FA55W, FURUKAWA CO., LTD.) | 30 parts |

-continued

| | |
|---|---|
| - Inorganic microparticles (colloidal silica, primary particle size: 12 nm, Aerosil 200, Nippon Aerosil Co., Ltd.) | 3 parts |
| - Polyvinyl alcohol (10% aqueous solution, Gosenol NLO5, The Nippon Synthetic Chemical Industry Co., Ltd.) | 100 parts |
| - Isopropyl alcohol | 40 parts |
| - Distilled water | 100 parts |
| Coating solution B for image-receptive layer | |
| - Dispersion A for image-receptive layer | 100 parts |
| - Surface roughening agent (amorphous silica, average particle diameter: 1.9 μm, Sylysia 530, Fuji Silysia Chemical Ltd.,) | 1 part |
| - Tetraalkoxysilane hydrolysate | 15 parts |

The tetraalkoxysilane hydrolysate was obtained by mixing the following components for a hydrolysis reaction at room temperature for 24 hours.

| | |
|---|---|
| - Tetraethoxysilane (regent, Wako Pure Chemical Industries, Ltd.) | 100 parts |
| - Ethanol | 100 parts |
| - 0.1 N Aqueous hydrochloric acid | 200 parts |

Comparative Example 1

A lithographic plate material was obtained in the same manner as in Example 1 except that the surface roughening agent was not added in the preparation of Coating solution B for the image-receptive layer.

Comparative Example 2

A lithographic plate material was obtained in the same manner as in Example 1 except that the surface roughening agent was changed as described below in the preparation of Coating solution B for the image-receptive layer.

| Coating solution B' for the image-receptive layer | |
|---|---|
| - Dispersion A for image-receptive layer | 100 parts |
| - Surface roughening agent (silica, average particle diameter: 3.0 μm, Sylysia 730, Fuji Silysia Chemical Ltd.,) | 1 part |
| - Surface roughening agent (silica, average particle diameter: 6.0 μm, Sylysia 770, Fuji Silysia Chemical Ltd.,) | 1 part |
| - Tetraalkoxysilane hydrolysate | 15 parts |

The values indicating surface roughness (arithmetical mean deviation Ra and 10-point height of irregularities Rz) of the lithographic plate materials obtained in Example 1 and the comparative examples are shown in Table 1.

TABLE 1

| | Ra | Rz |
|---|---|---|
| Example 1 | 0.35 | 2.00 |
| Comparative Example 1 | 0.13 | 0.89 |
| Comparative Example 2 | 0.58 | 3.67 |

Transfer Property

Lithographic plates were prepared from the lithographic plate materials obtained in Example 1 and in the comparative examples by outputting 3–18 point characters of Mincho typeface, screen tint images with 85 lines of 10%, 30%, 50% and 70% and black solid image as digital data using an ink ribbon hot-melt transfer printer having a hot-melt transfer ink ribbon with an ink layer of a thickness of 1 μm and having a serial head of 600 DPI. For these printing plates, the following Evaluation of printer output image (1) was performed. Then, printing was performed under the following conditions by using the above printing plates without desensitization treatment, and transfer of the ink layer was evaluated by Evaluation of white omission in solid image portions of printed matter (2) and Evaluation of scumming in non-image portions of printed matter due to rubbing by the ribbon (3). The results are shown in Table 2.

| Printing conditions: | |
|---|---|
| Printing machine: | Heidelberg Quick Master QM 46-1 |
| Printing speed: | 6000 sheets/hour |
| Paper: | coated paper (OK Top Coat) |
| Ink: | TK High Echo Sumi M: TOYO INK MFG. CO., LTD. |
| Fountain solution: | Astro Mark 3, Nikken Kagaku Kenkyusho, diluted 50 times with tap water |

Evaluation (1) Evaluation of Printer Output Image

Evaluation ○: White omissions were not observed in black solid image portions and black scumming was not produced in non-image portions due to rubbing by the ink layer on the aforementioned lithographic plates.

Evaluation X: White omissions were observed in black solid image portions on the aforementioned lithographic plates, or black scumming was produced in non-image portions due to rubbing by the ink layer.

(2) Evaluation of White Omissions in Solid Image Portions of Printed Matter

Evaluation ○: White omissions were not observed in black solid image portions of the printed matter.

Evaluation X: White omissions were observed in black solid image portions of the printed matter.

(3) Evaluation of Scumming in Non-image Portions of the Printed Matter Due to Rubbing by the Ribbon Evaluation ○: Scumming due to rubbing by ribbon was not observed in non-image portions of the printed matter.

Evaluation X: Scumming due to rubbing by the ribbon was observed in non-image portions of the printed matter.

Fixation Property

Printing durability was examined by observing the printed matter prepared in the aforementioned evaluation of transfer to evaluate fixation of ink on the image-receptive layer. The results are shown in Table 2.

Evaluation ○: Characters of 3–18 points in Mincho typeface and screen tint images with 85 lines of 10%, 30%, 50% and 70% were sufficiently resolved and reproduced even when the number of printed sheets exceeded 5000.

Evaluation X: Partial deletion was observed for characters in Mincho typeface and the screen tint images when the number of printed sheets reached 100.

Water Retention Property

Water retention by the image-receptive layer was evaluated by observing whether scumming due to insufficient water retention was caused on the printed matter prepared in the aforementioned evaluation of transfer. The results are shown in Table 2.

Evaluation ○: Scumming due to insufficient water retention did not occur at all on the 100th printed sheet of the printed matter.

Evaluation X: Scumming due to insufficient water retention did occur on the 100th printed sheet of the printed matter.

TABLE 2

| Sample | Transfer property: Image reproducibility on printed matter | Transfer property: White omission in solid image | Transfer property: Scumming in non-image portion by rubbing | Fixation property Printing durability | Water retention property Scumming in non-image portion on printed matter |
|---|---|---|---|---|---|
| Example 1 | ○ | ○ | ○ | ○ | ○ |
| Comparative Example 1 | ○ | ○ | ○ | X | X |
| Comparative Example 2 | X | X | X | ○ | ○ |

As seen from the results shown in Tables 1 and 2, since both of the arithmetic mean deviation Ra and the 10-point height of irregularities Rz were small in the lithographic plate material of Comparative Example 1, it did not show printing durability at all due to the poor ink fixation, while it showed good ink transfer. Further, when it was made into a printing plate, scumming occurred in non-image portions, because sufficient water retention could not be obtained for the printing plate.

As for the lithographic plate material of Comparative Example 2, it showed good water retention because the arithmetic mean deviation Ra was within the defined range. However, since the 10-point height of irregularities Rz was large, protrusions penetrated the ink layer so that white omissions occurred in the black solid image portions. In addition, protrusions in non-image portions rubbed the ink layer to cause scumming. Therefore, white omissions and scumming were also seen in the printed matter.

On the other hand, the lithographic plate material of Example 1, which had an arithmetic mean deviation Ra and 10-point height of irregularities Rz within suitable ranges, showed good transfer and fixation of ink, and good water retention when made into a printing plate.

What is claimed is:

1. A lithographic plate material comprising a support and an image-receptive layer for hot-melt transfer recording formed on the support, wherein the image-receptive layer has a water retention property or can be imparted with water a retention property on the support, and has surface roughness (JIS-B0601-1994) of 0.15 $\mu$m or more in terms of arithmetical mean deviation Ra and 1.00–3.00 $\mu$m in terms of 10-point height of irregularities Rz.

2. The lithographic plate material according to claim 1, wherein the image-receptive layer contains a surface roughening agent having an average particle diameter of 1.0–3.0 $\mu$m.

3. The lithographic plate material according to claim 1, wherein the image-receptive layer contains a hydrophilic polymer binder and a surface roughening agent having an average particle diameter of 1.5–2.5 $\mu$m.

4. The lithographic plate material according to claim 3, wherein the hydrophilic polymer binder is a crosslinked hydrophilic polymer compound.

5. The lithographic plate material according to claim 3, wherein the image-receptive layer contains 5–100 parts by weight of the surface roughening agent per 100 parts by weight of the hydrophilic polymer binder.

* * * * *

UNITED STATES PATENT AND TRADEMARK OFFICE

CERTIFICATE OF CORRECTION

PATENT NO. : 6,564,712 B2
DATED : May 20, 2003
INVENTOR(S) : Sato et al.

It is certified that error appears in the above-identified patent and that said Letters Patent is hereby corrected as shown below:

Column 3,
Line 9, “it” should read -- is --.

Column 5,
Line 39, “Onto” should read -- onto --.

Column 10,
Line 20, after “with” insert -- a --; and
Line 21, delete “a”.

Signed and Sealed this

Ninth Day of September, 2003

JAMES E. ROGAN
*Director of the United States Patent and Trademark Office*